US006416056B1

(12) United States Patent
Knieriemen

(10) Patent No.: US 6,416,056 B1
(45) Date of Patent: Jul. 9, 2002

(54) CHESS GAME FOR MULTIPLE PLAYERS

(75) Inventor: Alan J. Knieriemen, 445 N. 400 East, Valparaiso, IN (US) 46383

(73) Assignee: Alan J. Knieriemen, Valparaiso, IN (US)

( * ) Notice: Subject to any disclaimer, the term of this patent is extended or adjusted under 35 U.S.C. 154(b) by 0 days.

(21) Appl. No.: 09/474,238

(22) Filed: Dec. 29, 1999

Related U.S. Application Data

(60) Provisional application No. 60/114,448, filed on Dec. 31, 1998.

(51) Int. Cl.[7] ..... A63F 3/02
(52) U.S. Cl. ..... 273/261; 273/262
(58) Field of Search ..... 273/260, 261, 273/236, 258, 285, 262

(56) References Cited

U.S. PATENT DOCUMENTS 3,533,627 A * 10/1970 Deffenbaugh
3,836,149 A 9/1974 Adams et al.
3,963,242 A * 6/1976 Treugut
3,964,747 A * 6/1976 Balmforth
3,998,464 A 12/1976 Poturalski
4,229,008 A 10/1980 Jameson
4,653,759 A 3/1987 Anderson et al.
4,739,992 A * 4/1988 May
5,158,302 A 10/1992 Rewega
5,209,488 A 5/1993 Kimball
5,344,153 A * 9/1994 Watanabe
5,403,012 A * 4/1995 Stein
6,070,871 A * 9/1998 Wilson

* cited by examiner

*Primary Examiner*—Benjamin H. Layno
*Assistant Examiner*—Vishu K. Mendiratta

(57) ABSTRACT

A chess board and game that use the standard pieces of king, queen, bishop, knight, rook and pawn as the first formation played on a board made up of triangular spaces. Three board variations are disclosed, each having a six-sided playing field divided to define a pattern of contiguous triangular spaces, such that each space is defined by three flats interconnected at three points. Each side of the playing field is defined entirely by one or more of the flats, and the entire playing field within the six sides is occupied by the spaces. Optional added pieces and formations are offered with the emphasis on multiformal flexibility to increase the probability that players will learn to play chess for fun.

5 Claims, 5 Drawing Sheets

CHESS GAME FOR MULTIPLE PLAYERS

CROSS REFERENCE TO RELATED APPLICATIONS

This application claims the benefit of U.S. Provisional Application No. 60/114,448, filed Dec. 31, 1998.

BACKGROUND OF THE INVENTION

1. Field of the Invention

The present invention generally relates to chess. More particularly, this invention relates to chess games for two to six players and played on a playing surface with equilateral triangles in patterns arranged to allow practical and consistent use of the standard compliment of chess pieces, optionally with the addition of new pieces, with emphasis on the formation of a multiformal system that will allow as many people as possible to enjoy playing the game of chess for fun.

2. Description of the Prior Art

If the object for a chessboard is multiformal play, board space is a major concern. By the rules of geometry it can be shown that a playing surface made up of equilateral triangles allows more than twice the number of spaces as a board made up of squares having the same side length as the triangle. The end result is the area of the square is more than two times the area of the triangle. Applied to a game board surface, this fact means that a lot more can happen in less space. If the object is to teach chess for fun, a multiformal system is essential as the diversity of interest and expectation is limitless.

U.S. Pat. No. 3,963,242 to Treugut et al. discloses a chess game for more than two people that uses a game board with triangular spaces. Treugut et al. teach that the chess pieces are set up on extensions off of the edges of the playing area, such that the starting positions (bases) for the chess pieces for different players are separated by a nonplayable area. There is no provision for the play of two persons positioned at opposite sides of the board. While two players could play at two sides with one side vacant, the result would be completely unlike conventional square board chess. The size of the actual playing surface of Treugut et al. between the piece bases is a grid of 6 by 6 by 6, which provides 52 available spaces for play.

BRIEF SUMMARY OF THE INVENTION

The present invention provides a chess board and game that use the standard pieces of king, queen, bishop, knight, rook and pawn as the first formation played on a board made up of triangular spaces. Optional added pieces and formations are offered with the emphasis on multiformal flexibility to increase the probability that players will learn to play chess for fun, including all other forms of chess such as Chinese chess and variations of International 8×8 square board chess.

Three board variations are disclosed, each having a six-sided playing field divided to define a pattern of contiguous triangular spaces, such that each space is defined by three flats interconnected at three points. Each side of the playing field is defined entirely by one or more of the flats, and the entire playing field within the six sides is occupied by the spaces. In other words, the spaces fill the entire playing field, which includes regions between those spaces used for piece set up. A first of the board variations is preferably made up of equilateral triangles of thirteen ranks and twenty-five files, approximating a hexagonal board with edges of 11-13-11-13-11-13 spaces and a total playing area composed of 253 spaces. As used herein, "ranks" are rows aligned left to right from the position of a player at "rank zero," and "files" are columns aligned front to back relative to the player at rank zero. With ranks labeled numerically from zero to twelve and files labeled alphabetically from "A" to "Y," the board is labeled in the same rank and file designation system as used with International square board chess to allow games to be recorded using the same general notation. An important mechanical feature of the present invention is the provision for the play of two persons positioned at opposite sides of the board by covering rank zero with a suitable cover, in addition to the play of three persons at every other edge of the board. Rank zero may be covered or uncovered to provide a board that is effectively two boards in one.

A second board variation is made up of equilateral triangles of eighteen ranks and thirty-five files, and approximates a triangular board with three alternating sides of thirty-five spaces each, three alternating sides of one space each, and a total of 368 spaces. Another board variation employs equilateral triangles of twenty-two ranks and forty-three files, forming a hexagon with six edges of twenty-one spaces each and a total of 746 spaces.

In a mechanical sense, the triangular grid used by the present invention is a direct function of the piece setup. Boards in the first variation are specifically designed around how the initial configuration of standard pieces is set up in square board chess. The second and third board variations are generated from an extension of the basic board, but the general pattern of piece set up remains the same. Setup of the standard compliment of king, queen, bishops, knights, rooks and pawns reside on diamond patterns, each formed by the junction of two triangular spaces at shared flats. This allows hourglass patterns, formed between diamonds by two triangles joined at their points, to be used for optional pieces without altering the mechanical structure of the board.

Movements of the king, queen, bishop, knight, rook and pawn are adapted from square board chess, and are clearly defined on the triangular grid. Added to these standard pieces are optional pieces named the "executioner," "falcon," "jester," "maiden," "dog" and "cat," with their movements clearly defined on the triangular grid. These optional pieces may be added to the standard chess piece formation, or may replace pieces in the standard formation as part of the multiformal system of this invention. Accordingly, with the present invention, players are able to choose what board to play on and what pieces to use. To further enhance the multiformal system, "checkmate" of the standard chess play is defined in several different ways in the present invention. At the start of game play, players may decide what form of checkmate will be used for that game. Players are able to choose the form of checkmate used based on levels of difficulty and interest.

The games made possible by the present invention differ from the prior art both mechanically and philosophically. The games of the present invention are designed to allow serious chess players to enjoy playing on a triangular field, as well as to allow as many people as possible to enjoy the playing of chess as a whole. This means getting people to play and enjoy all forms of chess both existing and yet to come.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

The present invention provides a chess game played on a playing surface defined by a triangular grid that allows for practical and consistent use of a standard compliment of chess pieces, optionally with the addition of new pieces, with emphasis on the formation of a multiformal system that will allow two or more players to enjoy playing the game of chess for fun. Knowledge of the basic evolution of the present invention is necessary to more fully understand its concept.

The original object of the invention was to device a system in which the standard playing pieces (king, queen, bishop, knight, rook and pawn) of International Square Board Chess could be transferred from a square grid to a triangular grid capable of serious two-player chess. Special care was taken to maintain the integrity of the square board chess system. Therefore, piece moves and relative positions were translated as closely as possible to the square board configuration as the geometry of a triangular grid would allow. The rank and file alphanumeric space identification system (shown in use with the embodiment of FIG. 1) was transferred from square board so that a similar system could be used to record serious two-player chess games. After the successful completion of a two-player game, it was determined that the two-player game could be expanded to three players with the addition of a rank "zero," the result of which is the board shown in FIG. 1. It was then determined that there were places in the standard setup of pieces that allowed for the creation and placement of optional pieces without changing the triangular grid configuration of the board. Such optional pieces provide a less serious counterpart to two-player chess. The game boards of FIGS. 2 and 3, which are specifically intended for more than two players, were developed from this premise, and consequently are extensions of the basic game board of FIG. 1 originally developed for serious two-player chess play.

Before discussing the details of the chess game and boards of this invention, definitions are provided for the following terms. Space: The enclosed area within a triangle defined on a board of this invention. Point: An apex of a triangle formed by the intersection of two sides of the triangle. Flat: The line or side between two points of a triangle. Rank: Rows of spaces aligned from left to right relative to a base point of reference ("rank zero") of the 253-space board of FIG. 1. File: Columns of spaces aligned from front to back relative to the base point of reference (rank zero) of the 253-space board of FIG. 1. Diamond: An area at the edge of the playing area formed by two spaces joined at their shared flat, with only a point of one of the spaces contacting the edge. Hourglass: An area at the edge of the playing area formed by two spaces joined at their shared point, with only a flat of one of the spaces contacting the edge.

Figure 1:
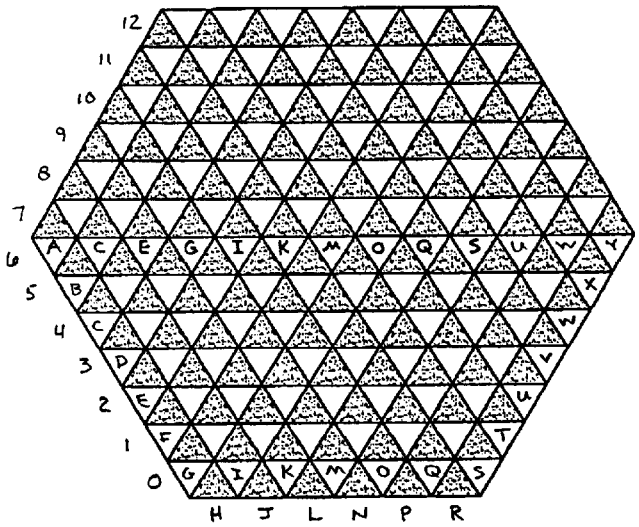
FIGS. 1 through 3 show board configurations in accordance with three different embodiments of the invention.

With reference to FIG. 1, a six-sided chess board (or any other possible playing field, as might be generated on a computer monitor or printed on a mat) is shown as being divided to define a homogeneous pattern of contiguous equilateral triangular spaces, such that each space has three flats shared with three contiguous spaces and three points shared with five contiguous spaces. The triangles are arranged and identified as follows:

Rank Zero, comprised of 13 spaces, identified as GO to SO.
Rank 1, comprised of 15 spaces, identified as F1 to T1.
Rank 2, comprised of 17 spaces, identified as E2 to U2.
Rank 3, comprised of 19 spaces, identified as D3 to V3.
Rank 4, comprised of 21 spaces, identified as C4 to W4.
Rank 5, comprised of 23 spaces, identified as B5 to X5.
Rank 6, comprised of 25 spaces, identified as A6 to Y6.
Rank 7, comprised of 25 spaces, identified as A7 to Y7.
Rank 8, comprised of 23 spaces, identified as B8 to X8.
Rank 9, comprised of 21 spaces, identified as C9 to W9.
Rank 10, comprised of 19 spaces, identified as D10 to V10.
Rank 11, comprised of 17 spaces, identified as E11 to U11.
Rank 12, comprised of 15 spaces, identified as F12 to T12.

The spaces are shown as having two alternating indicia, e.g., shading as shown in FIG. 1, each space with a first indicia being surrounded by three spaces of the second indicia. The board shown in FIG. 1 can be set up for play by two or three players. Rank Zero can be covered or otherwise not used for two-person play. Piece setup for the initial standard formation for two-person play is as follows:

Player 1 (positioned at the upper edge of FIG. 1)
Pawns on F11, H11, J11, L11, N11, P11, R11 and T11; rooks on F12 and T12; knights on H12 and R12; bishops on J12 and P12; queen on L12; and king on N12.

Player 2 (positioned at the lower edge of FIG. 1)
Pawns on F2, H2, J2, L2, N2, P2, R2 and T2; rooks on F1 and T1; knights on H1 and R1; bishops on J1 and P1; queen on L1; and king on N1.

With pieces set up in this manner, all pieces are placed on diamonds (as defined above to be located along the edges of the playing area). The empty areas between diamonds are hourglasses, and may be used for the optional pieces of this invention with suggested positions as follows:

"Dogs" and "cats" on the empty spaces in the pawn ranks (E2, G2, I2, K2, M2, O2, Q2, S2 and U2; E11, G11, I11, K11, M11, O11, Q11, S11 and U11). In one embodiment, each player is provided with five dogs and four cats that may be placed on any given empty space of the player's pawn rank.

A "maiden" on G1, S1, G12 and S12.

A "jester" on I1, Q1, I12 and Q12.

A "falcon" on K1, O1, K12 and O12.

An "executioner" on M1 and M12.

The board of FIG. 1 set up for three players is as follows:

Player 1 (positioned at the upper edge of FIG. 1)
Player 1 is set up the same as player 1 for the two-person play except that the king and queen reverse positions: the king is on L12 and the queen is on N12.

Player 2 (positioned at the lower lefthand edge of FIG. 1)
Pawns on B7, C6, D5, E4, F3, G2, H1, I0; rooks on A7 and H0; knights on B6 and G1; bishops on C5 and F2; queen on D4; and king on E3.

Player 3 (positioned at the lower righthand edge of FIG. 1)
Pawns on Q0, R1, S2, T3, U4, V5, W6 and X7; rooks on R0 and Y7; knights on S1 and X6; bishops on T2 and W5; queen on U3; and king on V4.

The optional pieces described for two players may also be used in three-person play. They may be placed in the same general pattern as on the two-person board.

Each player moves one piece each turn in counterclockwise rotation. The first move in a two-person match is taken by the player with the lighter-colored pieces, as conventional. The first move in a three-person match is taken by the player whose pieces are located on ranks 11 and 12 (the upper edge of the board in FIG. 1).

Figure 4:
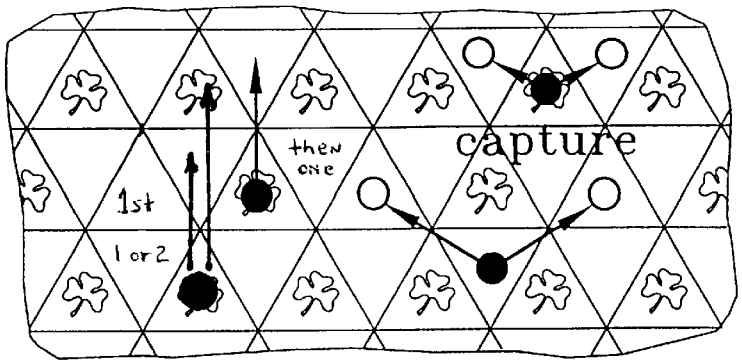
FIGS. 4 through 9 illustrate the movements of standard chess pieces on each of the boards of FIGS. 1 through 3 in accordance with this invention.

As is conventional, all capture moves are made by moving a piece into a space occupied by an opponent piece, removing the opponent piece from the board, and replacing it with the capturing piece. As shown in FIG. 4, each pawn makes an initial move forward toward the center of the board, and has a choice of a one or two-space move on the initial move, as is conventional. The move thereafter is one space forward. A pawn may never move backwards. The "capture" move for a pawn is diagonal (like a bishop, as discussed below). When on a space with a forward-facing point, capture is across a flat. When on a space with a foward-facing flat, the capture move is across one of the two forward points. As with conventional chess, any pawn able to cross the board, where it can move no farther forward because of the edge of the board, can be promoted to any piece of choice excluding the king.

Figure 5:
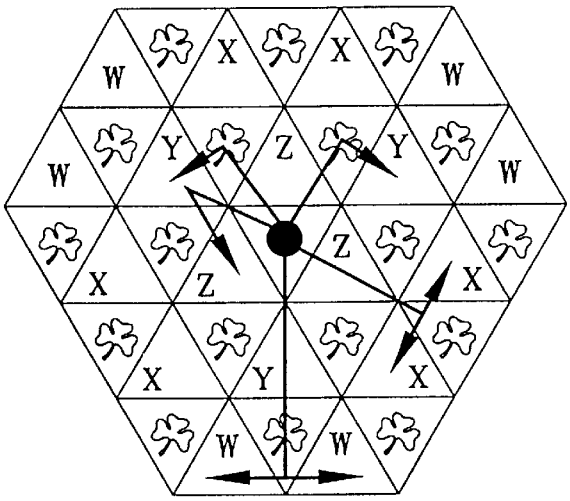

FIG. 5 shows each knight as being required to do three things within each move: (a) move like a rook (FIG. 6) and like a bishop (FIG. 7), and (b) make a turn in the move, and (c) move one space then two spaces, or two spaces followed by one space. The result is four possible combinations of three one-space movements: bishop-bishop-rook, bishop-rook-rook, rook-bishop-bishop, or rook-rook-bishop. As with standard chess rules, the knight is the only conventional piece allowed to jump over other pieces.

Figure 6:
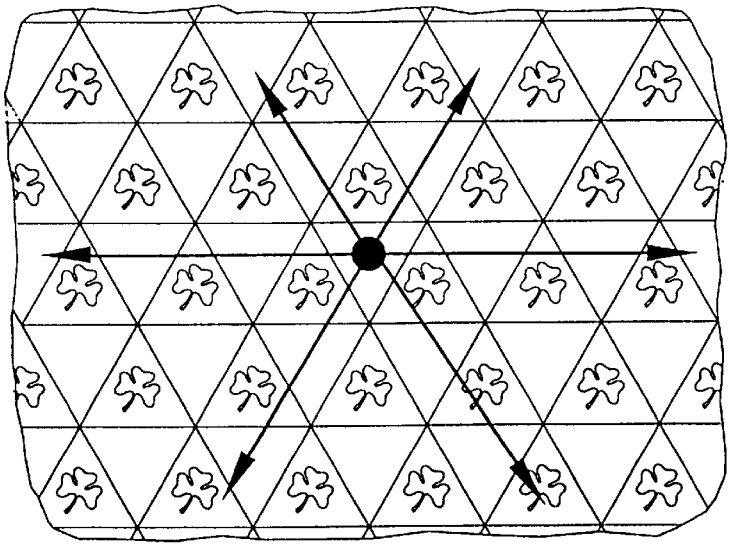
Figure 7:
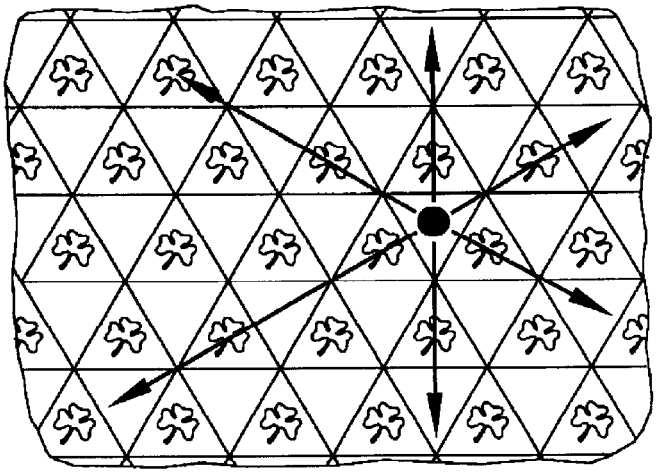
Figure 8:
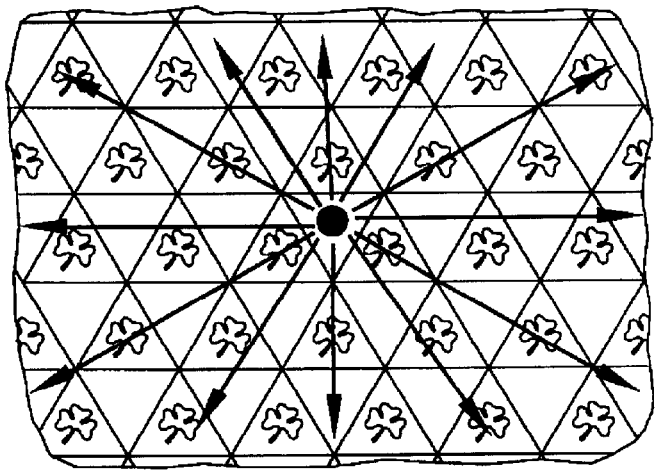
Figure 9:
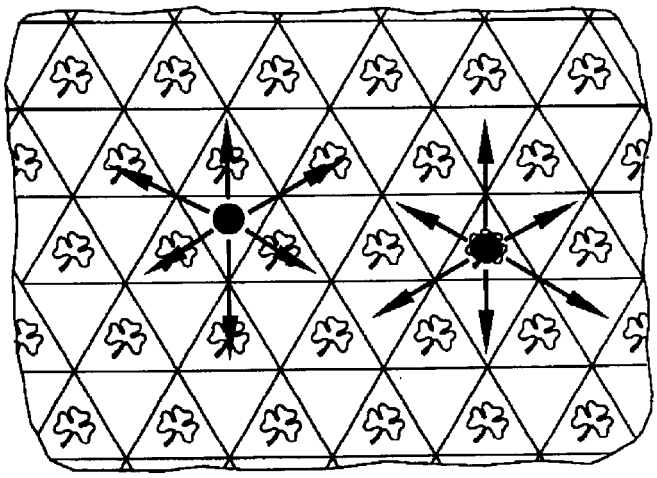
Figure 10:
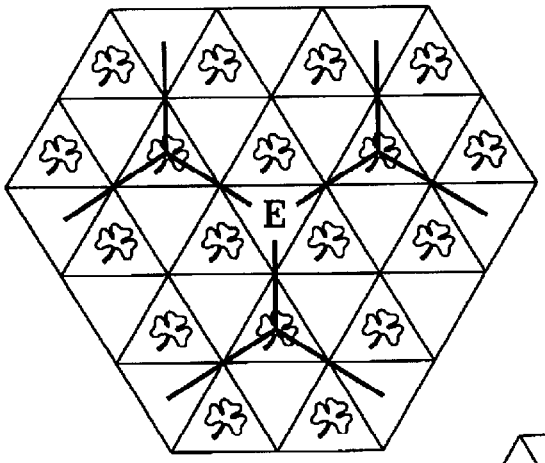
FIGS. 10 through 14 illustrate the movements of optional chess pieces on each of the boards of FIGS. 1 through 3 in accordance with this invention.
Figure 11:
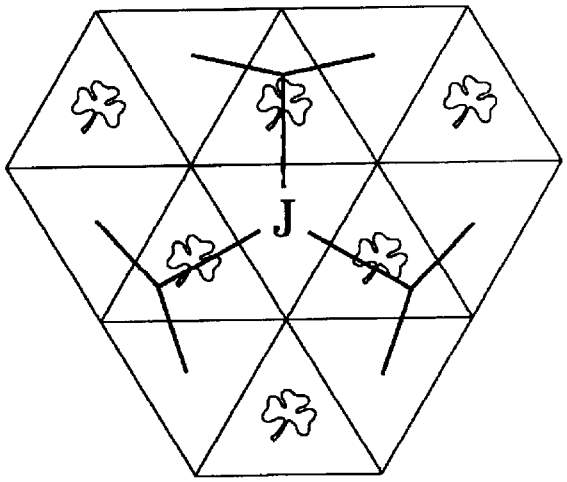
Figure 12:
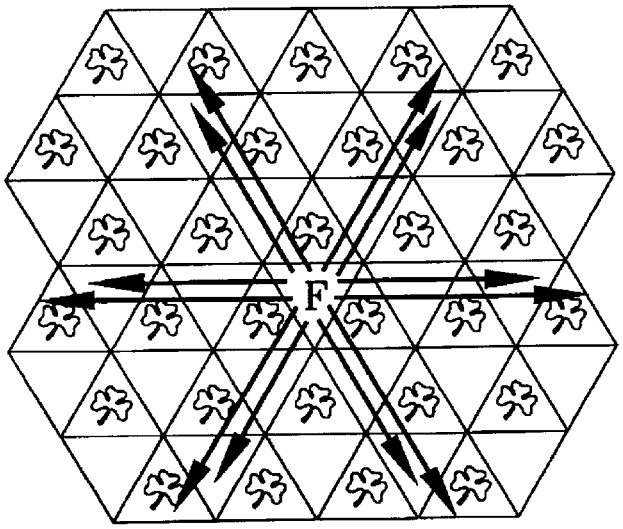
Figure 13:
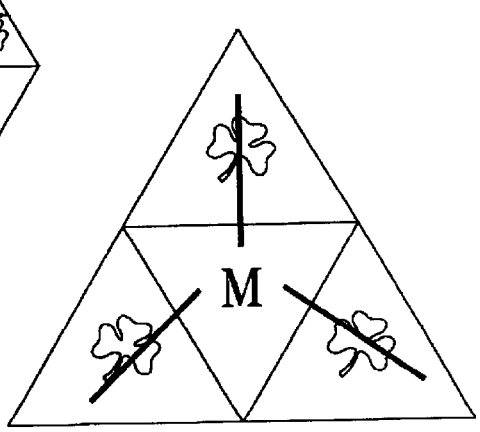

As shown in FIG. 6, each rook moves in one of six straight-line paths across flats (between parallel lines) as far as is open to it. Bishops are shown in FIG. 7 as being allowed to start a move in one of six paths across a point or flat of its space. It then continues to move in a straight-line path, crossing alternating points and flats as far as is open. As with conventional chess, the queen is allowed to move as a rook or bishop (not both in the same move), for a total of twelve different directions as shown in FIG. 8. The king moves one space in any of six directions—across any point or flat of the space on which the king is positioned, as shown in FIG. 9. As with conventional chess, the king may never move into check, i.e., where he could be captured during the next move of an opponent.

Figure 14:
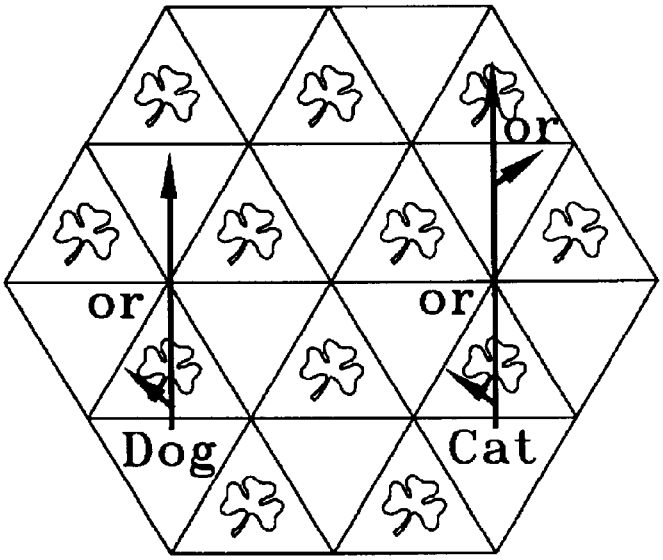

The moves of the new pieces introduced by the present invention are illustrated in FIGS. 10 through 14. The executioner ("E" in FIG. 10) moves one space across a point, turns and moves one more space across a point. The jester ("J" in FIG. 11) is limited to moves of two spaces across flats. The falcon ("F" in FIG. 12) moves across flats like a rook, but is limited to moves of either four or five. Also contrary to a rook, the falcon may jump other pieces if players so elect. The maiden ("M" in FIG. 13) is similar to the jester, but limited to moves of one space across a flat in any direction. In FIG. 14, dogs are shown to move like pawns, but can choose to move one or two spaces during any turn. Finally, cats also move like pawns, but are allowed to move one, two or three spaces during any turn, as indicated in FIG. 14. The capture move for a dog and a cat is the same one-space move as a pawn. However, dogs and cats are not promoted if they reach the opposite edge of the board.

Castling in the present invention can be done to king-side or queen-side, as in square board chess. To king-side, the king moves four spaces toward the rook, and the rook moves four spaces toward where the king started from, passing the king. To the queen-side, the king moves six spaces toward the rook, and the rook moves four spaces toward where the king started from, passing the king. Castling may not be done if (a) either the king or rook has been moved, (3) the king is in check, (c) any piece is between the king and the rook, or (d) the king must pass through any space where he would be in check.

Figure 2:
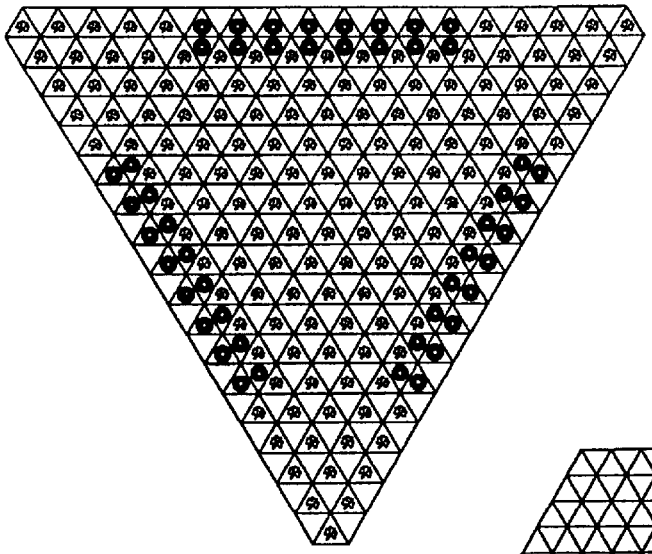
Figure 3:
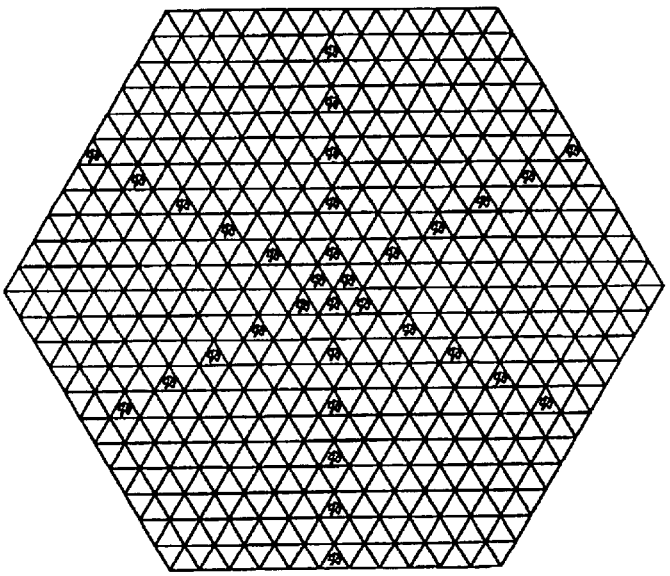

The piece moves described above are applicable to all of the boards shown in FIGS. 1 through 3, providing consistency that allows the game play to be maintained across the various board shapes and various modified piece setup formations.

As with conventional chess, the object of chess games played in accordance with the present invention is to capture, or checkmate, an opponent's king, i.e., to place the opponent's king in a position where he will be captured in the next move, and where there is no way he may defend by moving away, blocking or capturing the attacking piece. "Checkmate" may be defined in different ways to structure game play for multiple-person play. For example, under "king only removal" play, checkmate requires removal of only the captured king. The army of the removed king remain "frozen" in their places on the board for the rest of the game. Play resumes between the remaining players. The frozen pieces may be captured and removed normally without defense, but otherwise present blockades to the movements of remaining players. To win under these rules, only one king or team of kings must stand alone at the end of the game. Alternatively, "side removal" play requires removal of the checkmated king and his entire army. Play resumes between the remaining players. To win under "side removal" play, one king or team of kings must stand alone at the end of the game. Finally, under "king capture only" play, when a king is checkmated, he is only in a state of capture. At the time the king is captured, his army is frozen and may not move as long as their king is captured. Checkmate must be maintained on the captured king. When in a state of capture, the player with the captured king loses his or her normal turn. If at any time during the player's turn, the king is no longer checkmated, the king is free to move again and his army is no longer frozen. Under "king capture only" play with three players, if the king of one player is checkmated by a second player, and then the king of the second player is checkmated by the third player, the first player is again free to move. To win "king capture only," one king or team of kings must checkmate all others.

With reference now to FIG. 2, a chess board in accordance with a second embodiment of this invention is formed by extending each of the eleven-space sides of the board shown in FIG. 1 outward by five rows, to yield a board with 368 spaces. Though having a triangular-shaped appearance, the board has six sides, three of which are formed by the flat of a single space. Piece setup (pieces are indicated by hollow bullets in FIG. 2) is in the same spaces on this board as on the board of FIG. 1 for three-person play. The same piece moves and forms of checkmate apply to this board.

Figure 15:
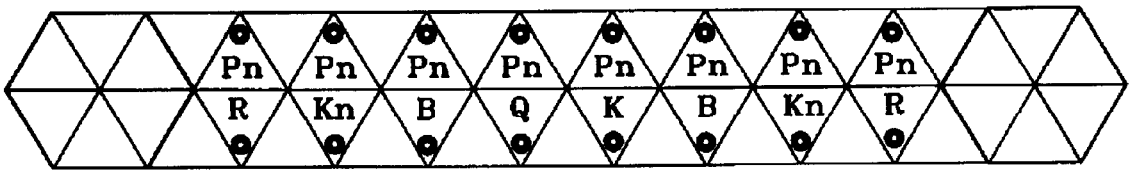
FIG. 15 shows the general piece setup for the board configuration of FIG. 3.

Finally, FIG. 3 shows a hexagonal chess board with equilateral triangles of twenty-two ranks, forty-three files and 746 spaces. This board is for two to six players, who may play as individuals or as teams, e.g., three teams of two or two teams of three. Individuals may also play more than one side at a time, e.g., two teams of one or three teams of one. Highly skilled players may even play as individuals against teams in the same game. Piece setup on the hexagonal board is shown in FIG. 15. Optional pieces may be added and formations may be changed to suit the players. Again, the same piece moves and forms of checkmate apply to play on the hexagonal board. Guide markings from the midpoints of the sides to the center of the hexagonal board can be added as shown in FIG. 3, in addition to conventional alternating light and dark shading of the spaces for general reference. These markings may be in the form of graphic symbols and/or color differences.

While the invention has been described in terms of a preferred embodiment, it is apparent that other forms could be adopted by one skilled in the art. Accordingly, the scope of the invention is to be limited only by the following claims.

What is claimed is:

1. A two or three player chess board made up of a grid of equilateral triangles, ordered front to back in rows called ranks, ordered left to right in columns called files, with ranks labeled numerically zero thru twelve and files labeled alphabetically "A" thru "Y"; and further consisting 253 spaces for continuous piece movement inside a six sides boarder edge of the playing surface with no gaps or voids inhibiting piece movement.

2. A two or three player chess board from claim 1 further comprising, conventional chess pieces of King, Queen, Bishop, Knight, Rook and Pawn specifically constructed for the purpose of transferring pieces from conventional square board to a triangular grid, for two player serious one on one across the board chess, while maintaining the integrity and properties of conventional square board.

3. A two or three player chess board from claim 2 further comprising conventional chess pieces of King, Queen, Bishop, Knight, Rook, Pawn together with added new pieces of Maiden, Jester, Falcon, Executioner, Witch, Dog, and Cat, with an army set up on ranks one and two, and a second army set up on ranks eleven and twelve, physically covering rank zero for two persons.

4. A three or six player chess board made up of a grid of equilateral triangles, ordered front to back in rows called ranks, ordered left to right in columns called files, with twenty two ranks and forty three files; and further consisting 726 spaces for continuous piece movement inside a six sides boarder edge of the playing surface with no gaps or voids inhibiting piece movement.

5. A three or six player chessboard from claim 4 further comprising conventional chess pieces of King, Queen, Bishop, Knight, Rook, and Pawn together with added new pieces of Maiden, Jester, Falcon, Executioner, Witch, Dog, and Cat.

* * * * *